US011521534B2

(12) United States Patent
Huang et al.

(10) Patent No.: US 11,521,534 B2
(45) Date of Patent: Dec. 6, 2022

(54) DISPLAY DRIVING INTEGRATED CIRCUIT AND DISPLAY DEVICE FOR SHORT CIRCUIT DETECTION

(71) Applicant: SAMSUNG ELECTRONICS CO., LTD., Suwon-si (KR)

(72) Inventors: Shih Chiao Huang, Zhubei (TW); Jinwoo Kim, Changwon-si (KR); Tao-Jung Hung, Hsinchu (TW); Chulho Choi, Seoul (KR); Hajoon Shin, Hwaseong-si (KR); Myungho Seo, Zhubei (TW); Yongjoo Song, Hwaseong-si (KR); Shih-Hsiung Kuo, Zhubei (TW); Chui-Hsun Chiu, Hsinchu (TW); Jia Wei Chen, Hsinchu (TW); Chao Hsuan Liu, Zhubei (TW); Yu-Wen Chiou, Zhubei (TW)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 17/519,724

(22) Filed: Nov. 5, 2021

(65) Prior Publication Data

US 2022/0223087 A1 Jul. 14, 2022

(30) Foreign Application Priority Data

Jan. 13, 2021 (KR) ..... 10-2021-0004927

(51) Int. Cl.
*G09G 3/20* (2006.01)

(52) U.S. Cl.
CPC ..... *G09G 3/20* (2013.01); *G09G 2300/0809* (2013.01); *G09G 2310/0243* (2013.01); *G09G 2310/0291* (2013.01); *G09G 2310/08* (2013.01); *G09G 2330/08* (2013.01)

(58) Field of Classification Search
CPC ..... G09G 3/20; G09G 2300/0809; G09G 2310/0243; G09G 2310/0291; G09G 2310/08; G09G 2330/08
See application file for complete search history.

(56) References Cited

U.S. PATENT DOCUMENTS

| | | | | |
|---|---|---|---|---|
| 8,563,983 | B2 | 10/2013 | Hida et al. | |
| 9,064,456 | B2 | 6/2015 | Seo et al. | |
| 10,403,196 | B2 | 9/2019 | Shin et al. | |
| 10,607,562 | B2 | 3/2020 | Lee et al. | |
| 2014/0176524 | A1 | 6/2014 | Lee et al. | |
| 2017/0261800 | A1 | 9/2017 | Zhang et al. | |
| 2019/0385503 | A1* | 12/2019 | Lin | G09G 3/20 |
| 2019/0385505 | A1* | 12/2019 | Nakai | G09G 3/20 |

* cited by examiner

*Primary Examiner* — Sejoon Ahn
(74) *Attorney, Agent, or Firm* — Lee IP Law, P.C.

(57) ABSTRACT

A display driving integrated circuit includes a common voltage buffer configured to provide a common voltage to a display panel and when a line outputting the common voltage and a gate line are short-circuited, apply a first current to the gate line or receive a second current from the gate line; a current generator configured to sum currents respectively corresponding to the first current and the second current and output an output current obtained by the summing; and a current detector configured to convert the output current into an output voltage and output a high or low signal based on a result of comparing the output voltage with a preset voltage.

20 Claims, 9 Drawing Sheets

DISPLAY DRIVING INTEGRATED CIRCUIT AND DISPLAY DEVICE FOR SHORT CIRCUIT DETECTION

CROSS-REFERENCE TO RELATED APPLICATION

Korean Patent Application No. 10-2021-0004927, filed on Jan. 13, 2021, in the Korean Intellectual Property Office, and entitled: "Display Driving Integrated Circuit and Display Device for Short Circuit Detection," is incorporated by reference herein in its entirety.

BACKGROUND

1. Field

Embodiments relates to a display driving integrated circuit for detecting a short circuit, and a display including the same.

2. Description of the Related Art

A display panel may include a plurality of semiconductor devices, and the plurality of semiconductor devices may include a pixel electrode and a common electrode for maintaining a common voltage Vcom. The display device may include a common voltage substrate in a lower end of the display panel to apply the common voltage Vcom.

SUMMARY

Embodiments are directed to a display driving integrated circuit, including: a common voltage buffer configured to provide a common voltage to a display panel and, when a line outputting the common voltage and a gate line are short-circuited, apply a first current to the gate line or receive a second current from the gate line; a current generator configured to sum currents respectively corresponding to the first current and the second current, and output an output current obtained by the summing; and a current detector configured to convert the output current into an output voltage, and output a high or low signal based on a result of comparing the output voltage with a preset voltage.

Embodiments are directed to a display driving integrated circuit, including: a common voltage buffer configured to provide a common voltage to a display panel and, when a line outputting the common voltage and a gate line are short-circuited, apply a first current to the gate line or receive a second current from the gate line; a current generator configured to generate output currents respectively corresponding to the first current and the second current; and a current detector configured to convert the output currents respectively into a first output voltage and a second output voltage, and output a high or low signal based on a result of comparing the first output voltage with a preset voltage and a result of comparing the second output voltage with the preset voltage.

Embodiments are directed to a display device, including: a common voltage buffer configured to provide a common voltage to a display panel and, when a line outputting the common voltage and a gate line are short-circuited, apply a first current to the gate line or receive a second current from the gate line; a current generator configured to generate an output current corresponding to at least one of the first current and the second current; a current detector configured to convert the output current into an output voltage, and output a high or low signal based on a result of comparing the output voltage with a preset voltage; and a control logic configured to receive an output signal from the current detector, and generate a control signal according to the output signal.

BRIEF DESCRIPTION OF THE DRAWINGS

Features will become apparent to those of skill in the art by describing in detail example embodiments with reference to the attached drawings in which.

DETAILED DESCRIPTION

Figure 1:
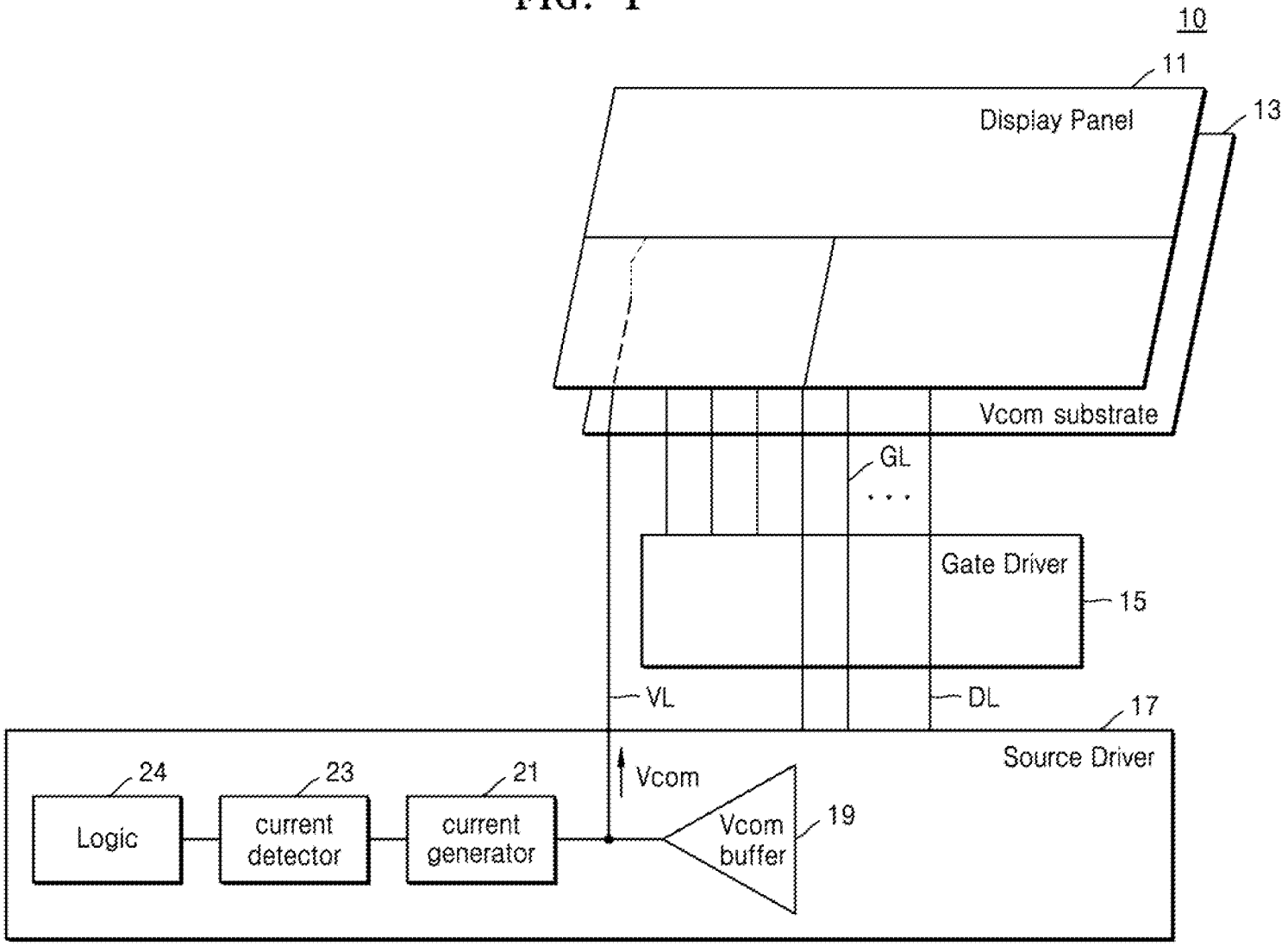
FIG. 1 is a block diagram illustrating a display device according to an example embodiment.

FIG. 1 is a block diagram illustrating a display device 10 according to an example embodiment.

In an example embodiment, the display device 10 may be included in an electronic device having an image display function. The electronic device may be, e.g., a smartphone, a tablet personal computer (PC), a portable multimedia player (PMP), a camera, a wearable device, an Internet of things device, a television, a digital video disk (DVD) player, a refrigerator, an air conditioner, an air purifier, a set-top box, a robot, a drone, a medical device, a navigation device, a global positioning system (GPS) receiver, an advanced drivers assistance system (ADAS), a vehicle device, furniture, or a measuring device.

Referring to FIG. 1, the display device 10 may include a display panel 11, a common voltage substrate 13, a gate driver 15, and a source driver 17. As described below with reference to FIG. 8, the display device 10 may include a power management integrated circuit (PMIC) and a timing controller (TCON).

The display panel 11 is a display unit on which an actual image is displayed, and may be one of display devices that receive an electrically transmitted image signal and display an image, such as a thin film transistor-liquid crystal display (TFT-LCD), an organic light emitting diode (OLED) display, a field emission display, a plasma display panel (PDP), etc.

The display panel 11 may include a plurality of signal lines, such as a plurality of data lines DL, a plurality of gate lines GL, a common voltage output line VL, and may include a plurality of pixels connected to the plurality of signal lines.

The common voltage substrate 13 may apply a common voltage Vcom output from a common voltage buffer 19 to the display panel 11. For example, the common voltage substrate 13 may apply the common voltage Vcom to common electrodes of a plurality of elements, e.g., semiconductor devices, included in the display panel 11.

The gate driver 15 may include a gate driver integrated circuit, and may drive the plurality of gate lines GL based on a control signal of the gate driver integrated circuit. The gate driver 15 may control the plurality of pixels by applying a gate high voltage VGH or a gate low voltage VGL to the plurality of gate lines GL.

The source driver 17 may include a source driver integrated circuit, and may drive the plurality of data lines DL based on a control signal of the source driver integrated circuit. The source driver 17 may apply image signals corresponding to image data received from a processor to the plurality of data lines DL. As described below with reference to FIG. 2, the gate driver 15 and the source driver 17 may be packaged on one film. For example, the gate driver 15 and the source driver 17 may be mounted as one package in a lower end of the display panel 11 in different vertical layers.

The source driver 17 may include a plurality of blocks detecting a short circuit between the gate line GL and the common voltage output line VL. The source driver 17 may include the common voltage buffer 19, a current generator 21, a current detector 23, and a control logic 24. The common voltage buffer 19 may output the common voltage Vcom to the common voltage substrate 13 and may be connected to the current generator 21. The current generator 21 may generate an output current corresponding to the current flowing through the common voltage buffer 19 and may be connected to the current detector 23. The current detector 23 may convert the current output from the current generator 21 into an output voltage, and may detect a short circuit between the gate line GL and the common voltage output lines VL based on a comparison result of the output voltage and a preset voltage. Although FIG. 1 shows that the common voltage buffer 19, the current generator 21, the current detector 23, and the control logic 24 are included in the source driver 17, the common voltage buffer 19, the current generator 21, the current detector 23, and the control logic 24 may also be implemented separately from the source driver 17.

Figure 2:
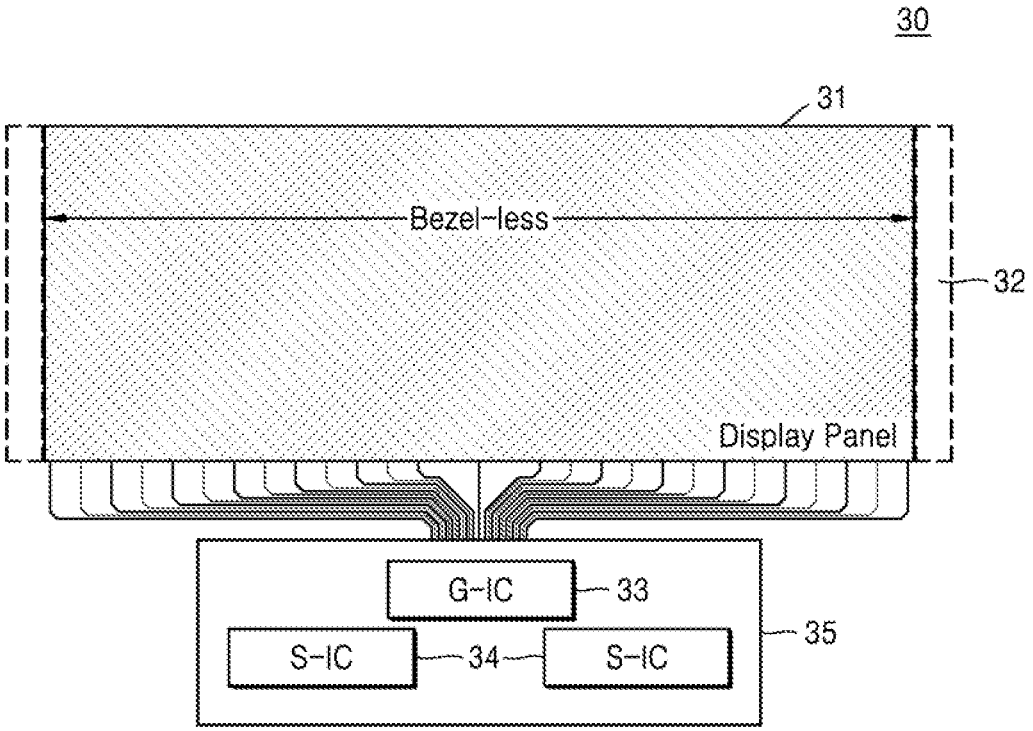
FIG. 2 is a diagram illustrating a display device according to an example embodiment.

FIG. 2 is a diagram illustrating a display device 30 according to an example embodiment. Hereinafter, FIG. 2 is described with additional reference to FIG. 1.

Referring to FIG. 2, in the display device 30, it may be considered to arrange a gate driver may be in left and right regions 32 of a display panel 31 to drive gate lines.

However, with the introduction of a technology (bezelless) that minimizes a peripheral space beyond the display viewing area, a display driving integrated circuit may be implemented to include a gate driver 33 disposed in a lower end of the display panel 31, while packaging the gate driver 33 and a source driver 34 in one film 35. In this case, an output line of the gate driver 33 and an output line of the source driver 34 may both be located on the one film 35, and thus a short circuit between the gate line GL and the common voltage output line VL may occur in the display panel 31. Moreover, a panel yield may be lowered if an overcurrent flows due to the short circuit.

As described herein, a display device according to an example embodiment may be implemented with functionality to detect a short circuit, e.g., between the gate line GL and the common voltage output line VL, and to control a voltage output, which may protect the display panel and improve panel yield.

Figure 3:
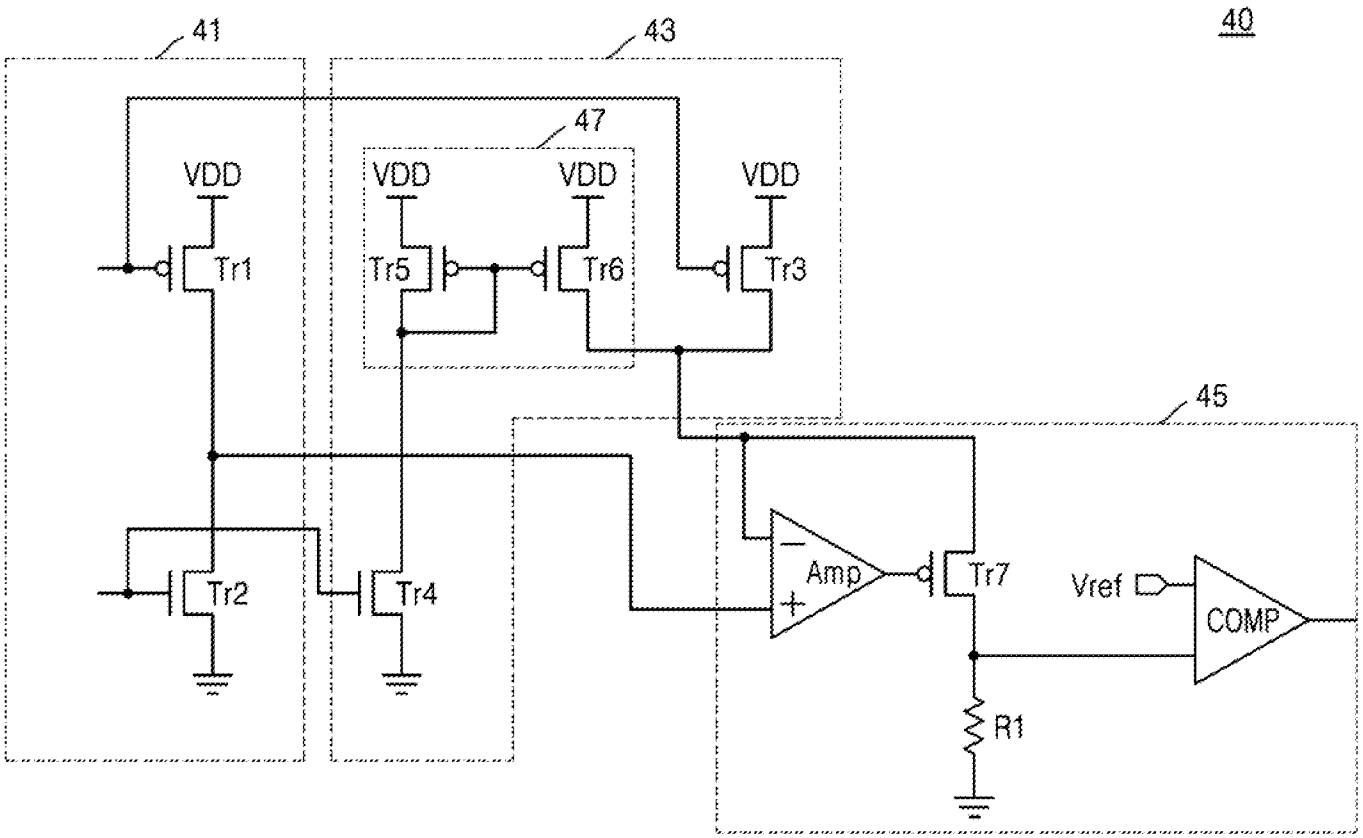
FIG. 3 is a diagram illustrating a display driving integrated circuit according to an example embodiment.

FIG. 3 is a diagram illustrating a display driving integrated circuit 40 according to an example embodiment.

Referring to FIG. 3, the display driving integrated circuit 40 may include a common voltage buffer 41, a current generator 43, and a current detector 45.

The common voltage buffer 41 may include a first transistor Tr1 and a second transistor Tr2. The first transistor Tr1 may be configured as a PMOS transistor, and the second transistor Tr2 may be configured as an NMOS transistor. The first transistor Tr1 and the second transistor Tr2 may be sequentially connected in series between a power voltage VDD and ground. For example, a source of the first transistor Tr1 may be connected to the power voltage VDD. A drain of the first transistor Tr1 may be connected to the second transistor Tr2. For example, the drain of the first transistor Tr1 may be connected to a drain of the second transistor Tr2. A source of the second transistor Tr2 may be connected to the ground. A gate of the first transistor Tr1 may be connected to a third transistor Tr3. For example, the gate of the first transistor Tr1 may be connected to a gate of the third transistor Tr3. A gate of the second transistor Tr2 may be connected to a fourth transistor Tr4. The first transistor Tr1 and the second transistor Tr2 may be driven based on a control signal output from a processor included in the display device (e.g., the display device 100 of FIG. 1). Although FIG. 3 shows that the common voltage buffer 41 includes only the first transistor Tr1 and the second transistor Tr2 corresponding to outputs, the common voltage buffer 41 may further include a plurality of devices.

In an example embodiment, the current generator 43 may include the third transistor Tr3, the fourth transistor Tr4, and a current mirror 47. The third transistor Tr3 may be configured as a PMOS transistor, and the fourth transistor Tr4 may be configured as an NMOS transistor. A source of the fourth transistor Tr4 may be connected to the ground, a gate thereof may be connected to the second transistor Tr2, and a drain thereof may be connected to the current mirror 47. For example, the gate of the fourth transistor Tr4 may be connected to the gate of the second transistor Tr2, and the drain of the fourth transistor Tr4 may be connected to a drain of a fifth transistor Tr5. The fifth transistor Tr5 and a sixth transistor Tr6 included in the current mirror 47 may be PMOS transistors having the same characteristics. In the current mirror 47, a gate and the drain of the fifth transistor Tr5 may be connected to each other, and the gate of the fifth transistor Tr5 may be connected to a gate of the sixth transistor Tr6, and thus, the current mirror 47 may generate a mirror current corresponding to a common current flowing through the fourth transistor Tr4.

The current detector 45 may include an amplifier Amp, a seventh transistor Tr7, a resistor R1, and a comparator COMP. The first transistor Tr1 and the second transistor Tr2 may be connected to a first input terminal of the amplifier Amp, and the third transistor Tr3 and the sixth transistor Tr6 may be connected to a second input terminal of the amplifier Amp. For example, the drain of the first transistor Tr1 and the drain of the second transistor Tr2 may be connected to the first input terminal of the amplifier Amp, and the drain of the third transistor Tr3 and the drain of the sixth transistor Tr6 may be connected to the second input terminal of the amplifier Amp. The first input terminal of the amplifier Amp may be a non-inverting terminal, and the second input terminal thereof may be an inverting terminal. The current output from the current generator 43 may pass through the seventh transistor Tr7 and the resistor R1, and may be converted into an output voltage. The comparator COMP may compare the output voltage with a preset voltage Vref, output a low level signal when the output voltage is lower than the preset voltage Vref, and output a high level signal when the output voltage is greater than the preset voltage Vref. The current detector 45 may be connected to a control logic, and the control logic may generate a signal controlling a power management integrated circuit or the common voltage buffer 41 based on the signal output from the current detector 45.

Figure 4:
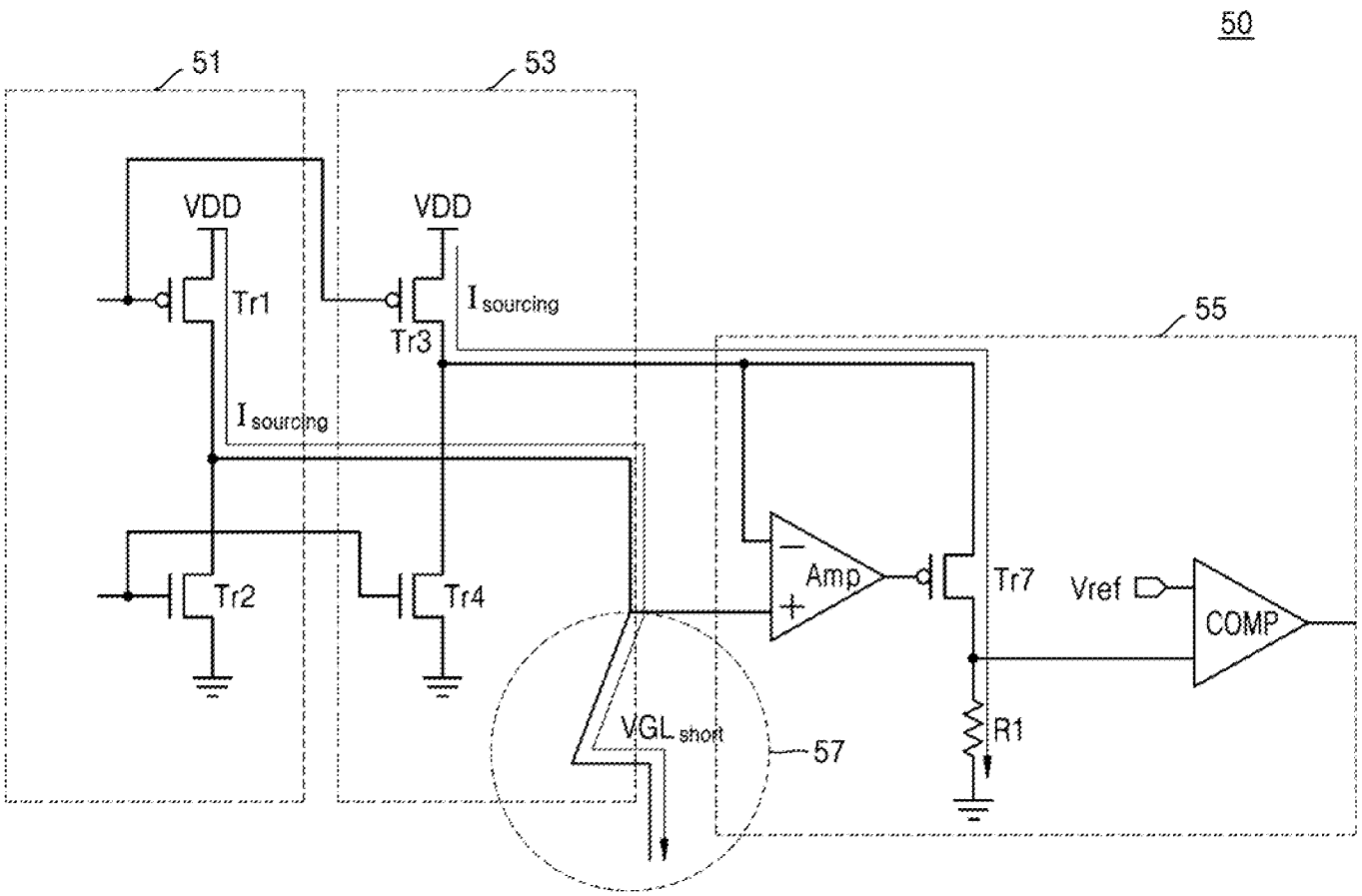
FIGS. 4 and 5 illustrate a current flow when a gate line and a common voltage output line are short-circuited in the display driving integrated circuit of FIG. 3 according to an example embodiment.

FIG. 4 illustrates a current flow in the display driving integrated circuit 40 of FIG. 3 when a gate line and a common voltage output line are short-circuited, according to an example embodiment. Specifically, FIG. 4 is a circuit diagram illustrating the current flow when the gate line to which a gate high voltage VGH is applied and the common voltage output line are short-circuited. In FIG. 4, a path through which the current flows is indicated as an arrow.

As described below with reference to FIGS. 4 and 5, when the common voltage output line and the gate line are short-circuited, a first current $I_{sourcing}$ or a second current $I_{sinking}$ may flow according to a level VGH or VGL of a gate voltage applied to the gate line. A display driving integrated circuit 50 may be designed separately based on the first current $I_{sourcing}$ or the second current $I_{sinking}$.

Referring to FIG. 4, the gate line to which a gate high voltage (VGH, e.g., 40 V) is applied and the common voltage output line may be short-circuited, and the first current $I_{sourcing}$ may flow through a short-circuited circuit 57. The first current $I_{sourcing}$ may be a current applied from a common voltage buffer 51 to the gate line, and may be referred to as a sourcing current.

In an example embodiment, the first current $I_{sourcing}$ may flow to the short-circuited circuit 57 through the first transistor Tr1. When the first transistor Tr1 is turned on, the same gate voltage may be applied to the third transistor Tr3. A drain of the first transistor Tr1 may be connected to a first input terminal of the amplifier Amp, and the amplifier Amp may operate so that voltages of both input terminals are the same. Thus, the same voltage as the drain voltage of the first transistor Tr1 may be applied to a drain of the third transistor Tr3 connected to a second input terminal of the amplifier Amp. The first input terminal of the amplifier Amp may be a non-inverting terminal, and the second input terminal thereof may be an inverting terminal. Accordingly, voltages applied to the gate, source, and drain of the third transistor Tr3 may be the same as voltages applied to the gate, source, and drain of the first transistor Tr1, and the same current as the first current $I_{sourcing}$ may flow through the third transistor Tr3.

The first current $I_{sourcing}$ may pass through the third transistor Tr3 and flow to the seventh transistor Tr7. The first current $I_{sourcing}$ passing through the seventh transistor Tr7 may be converted into an output voltage through the resistor R1. The comparator COMP may compare the output voltage and the preset voltage Vref. When a voltage higher than the preset voltage Vref is input due to a short circuit, the comparator COMP may output a high level signal. As described below with reference to FIG. 8, the comparator COMP may be connected to control logic. When the control logic receives the high level signal, the control logic may determine that a short circuit has been detected in the display driving integrated circuit 50 and generate a signal for controlling, e.g., at least one of a power management integrated circuit and the common voltage buffer 51.

Figure 5:
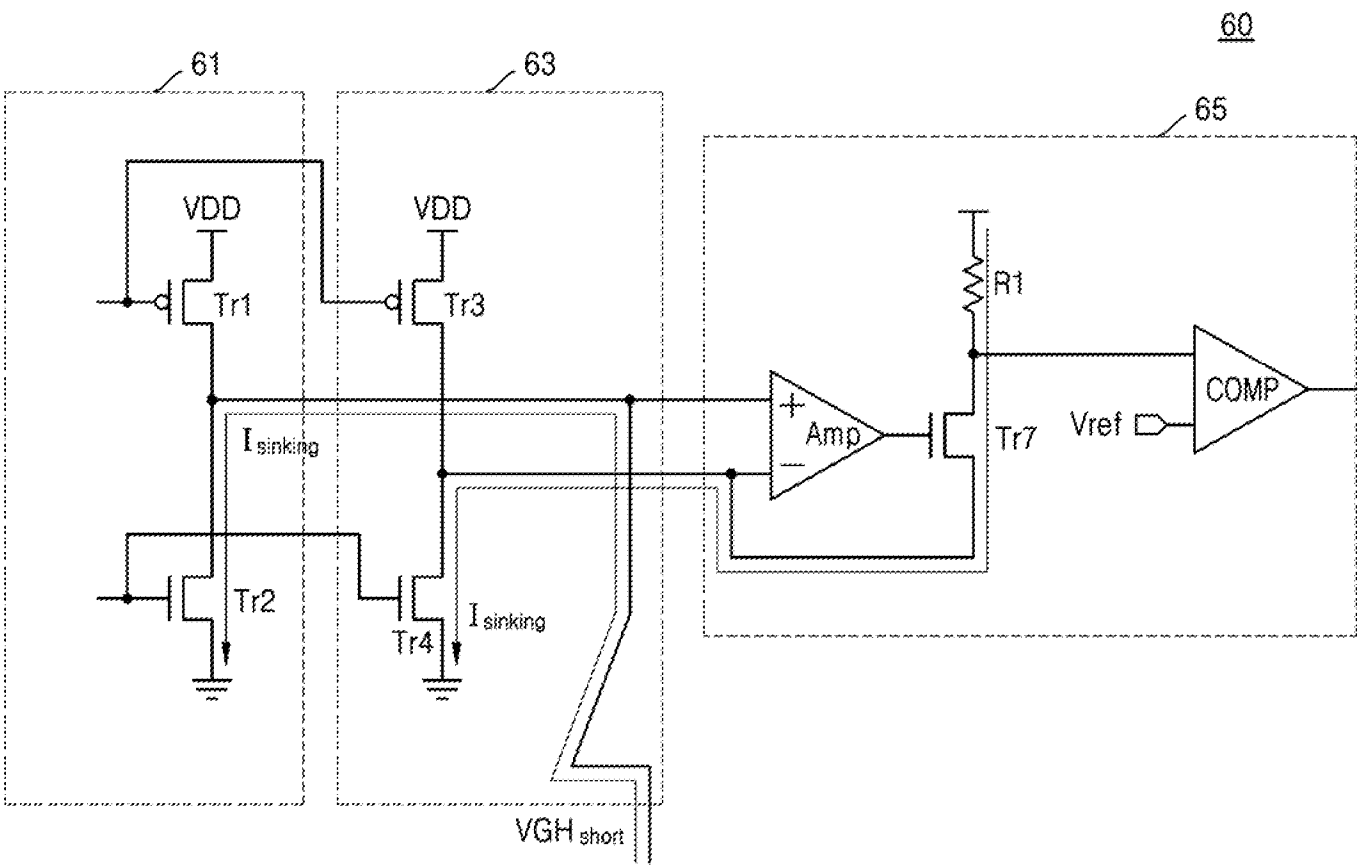

FIG. 5 illustrates a current flow in the display driving integrated circuit 40 of FIG. 3 when a gate line and a common voltage output line are short-circuited, according to an example embodiment. Specifically, FIG. 5 is a circuit diagram illustrating the current flow when the gate line to which a gate low voltage VGL is applied and the common voltage output line are short-circuited. In FIG. 5, a path through which the current flows is indicated as an arrow.

Referring to FIG. 5, the gate line to which a gate low voltage (VGL, for example −10 V) is applied and the common voltage output line may be short-circuited, and the second current $I_{sinking}$ may flow through the short-circuited circuit. The second current $I_{sinking}$ may be a current applied from the gate line to a common voltage buffer 61 and may be referred to as a sinking current.

The second current $I_{sinking}$ may flow from the short circuit to the second transistor Tr2. When the second transistor Tr2 is turned on, the same gate voltage may be applied to the fourth transistor Tr4. A drain of the second transistor Tr2 may be connected to a first input terminal of the amplifier Amp, and the amplifier Amp may operate so that voltages of both input terminals are the same. Thus, the same voltage as the drain voltage of the second transistor Tr2 may be applied to a drain of the fourth transistor Tr4 connected to a second input terminal of the amplifier Amp. The first input terminal of the amplifier Amp may be a non-inverting terminal, and the second input terminal thereof may be an inverting terminal. Accordingly, voltages applied to the gate, source, and drain of the fourth transistor Tr4 may be the same as voltages applied to the gate, source, and drain of the second transistor Tr2, and the same current as the second current $I_{sinking}$ may flow through the fourth transistor Tr4.

The second current $I_{sinking}$ may flow to the fourth transistor Tr4 through the resistor R1 and the seventh transistor Tr7. The second current $I_{sinking}$ may pass through the resistor R1 to be converted into an output voltage, and the comparator COMP may compare the output voltage with the preset voltage Vref. When a voltage higher than the preset voltage Vref is input due to the short circuit, the comparator COMP may output a high level signal. As described below with reference to FIG. 8, the comparator COMP may be connected to a control logic, and the control logic may determine that the short has been detected in a display driving integrated circuit 60 when receiving the high level signal, and may generate a signal for controlling, e.g., at least one of a power management integrated circuit and the common voltage buffer 61.

Figure 6:
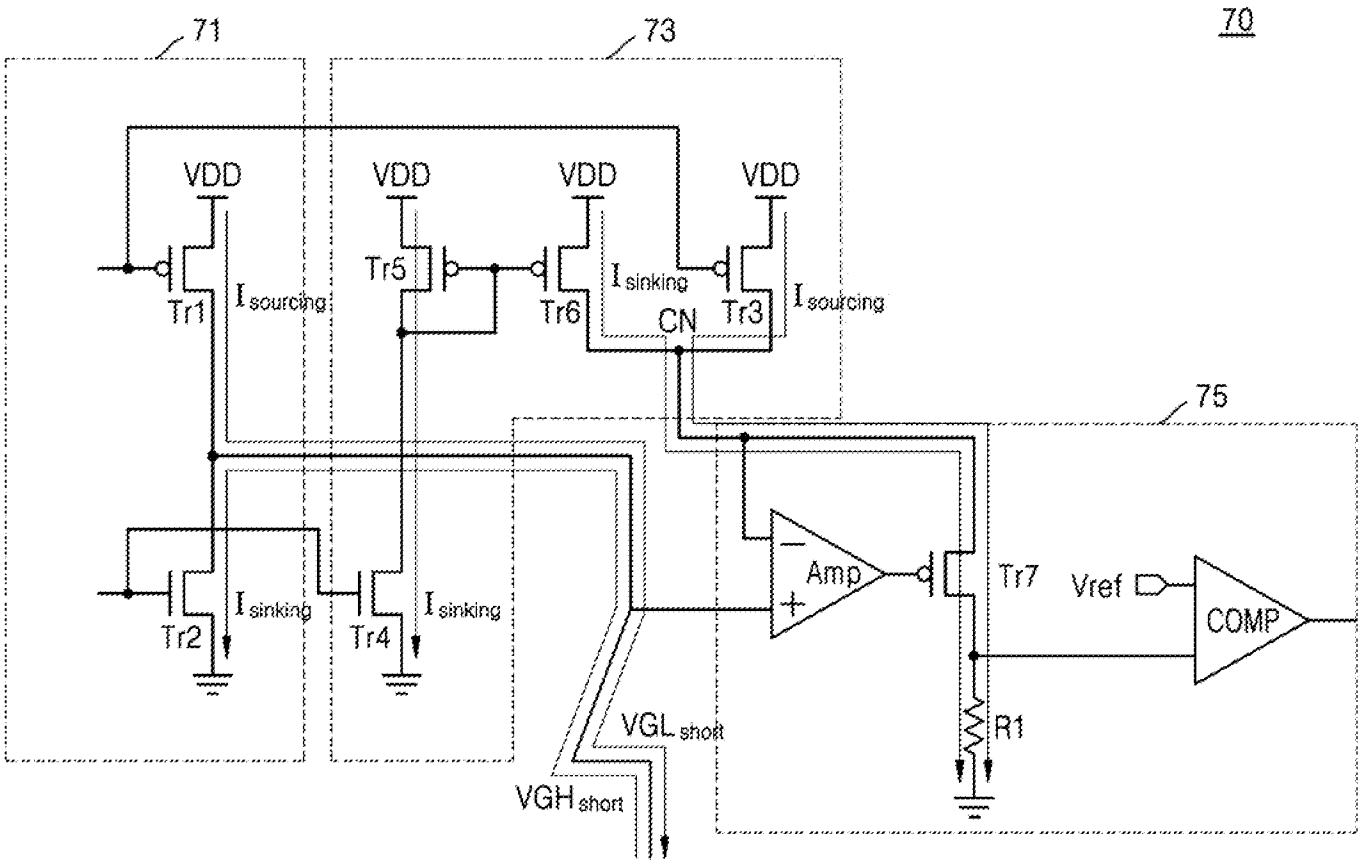
FIG. 6 is a circuit diagram of a display driving integrated circuit according to an example embodiment.

FIG. 6 is a circuit diagram of a display driving integrated circuit 70 according to an example embodiment. Specifically, the display driving integrated circuit 70 integrates the display driving integrated circuit 50 in FIG. 4 and the display driving integrated circuit 60 shown in FIG. 5 into one circuit.

When a gate line to which the gate low voltage VGL is applied and a common voltage output line are short-circuited, the first current $I_{sourcing}$ may be applied from a common voltage buffer 71 to the gate line. The first current $I_{sourcing}$ may flow to the gate line through the first transistor Tr1. Meanwhile, when the gate line to which the gate high voltage VGH is applied and the common voltage output line are short-circuited, the second current $I_{sinking}$ may be applied from the gate line to the common voltage buffer 71. For example, the second current $I_{sinking}$ may flow through the second transistor Tr2 from the gate line. As described above with reference to FIGS. 4 and 5, a current generator 73 may copy the first current $I_{sourcing}$ applied to the first transistor Tr1 and apply the first current $I_{sourcing}$ to the third transistor Tr3 and copy the second current $I_{sinking}$ applied to the second transistor Tr2 and apply the second current $I_{sinking}$ to the fourth transistor Tr4. The current applied to the fourth transistor Tr4 may be mirrored again through a current mirror and applied to the sixth transistor Tr6.

Referring to FIG. 6, a drain of the sixth transistor Tr6 and a drain of the third transistor Tr3 may be connected to the first node CN. The current generator 73 may output a current obtained by summing the first current $I_{sourcing}$ and the second current $I_{sinking}$ to a current detector 75 through a first node CN. The output current may pass through the seventh transistor Tr7 and the resistor R1 to be converted into an output voltage, and the comparator COMP may compare the output voltage with the preset voltage Vref. When a voltage higher than the preset voltage Vref is input due to a short circuit, the comparator COMP may output a high level signal. The display driving integrated circuit 70 may detect a short circuit through a single amplifier Amp and a single comparator COMP by outputting the current obtained by summing the first current $I_{sourcing}$ and the second current $I_{sinking}$. Accordingly, an integrated circuit of a smaller size may be provided.

Figure 7:
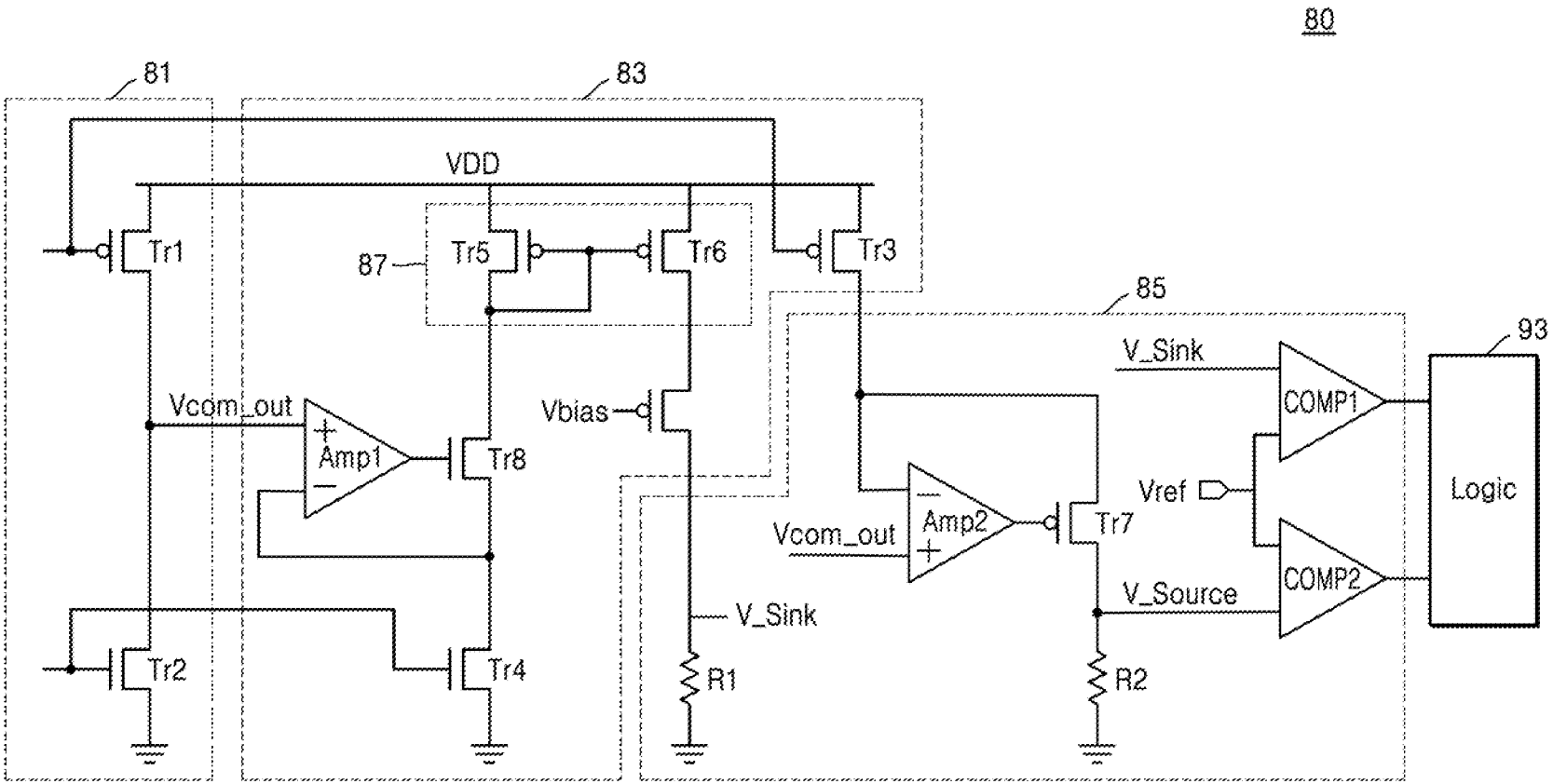
FIG. 7 is a circuit diagram of a display driving integrated circuit according to an example embodiment.

FIG. 7 illustrates a display driving integrated circuit 80 according to an example embodiment. Specifically, the display driving integrated circuit 80 may be a circuit in which mismatching of current is improved in the display driving integrated circuit 70 shown in FIG. 6.

Referring back to FIG. 6, when the display driving integrated circuit 70 is implemented using the single amplifier Amp, mismatching of current may occur. For example, voltages applied to a drain of the second transistor Tr2 and a drain of the fourth transistor Tr4 in the display driving integrated circuit 70 may not be the same, and there may be a slight difference in the intensity of a current flowing through the second transistor Tr2 and a current flowing through the fourth transistor Tr4.

Referring to FIG. 7, the display driving integrated circuit 80 may include a common voltage buffer 81, a current generator 83, and a current detector 85.

The current generator 83 may include a first amplifier Amp1. An output voltage Vcom_out of the common voltage buffer 81 may be input to a first input terminal of the first amplifier Amp1, and a drain of the fourth transistor Tr4 may be connected to a second input terminal of the first amplifier Amp1. For example, the first input terminal of the first amplifier Amp1 may be a non-inverting terminal, and the second input terminal thereof may be an inverting terminal. The first amplifier Amp1 may operate so that the voltages of both input terminals are the same. Thus, the same voltage as the output voltage Vcom_out may be applied to the drain of the fourth transistor Tr4 connected to the first input terminal of the first amplifier Amp1. Accordingly, the current flowing through the second transistor Tr2 and the current having the same intensity may flow through the fourth transistor Tr4, and mismatching of the current may be reduced or eliminated.

The current detector 85 may include a second amplifier Amp2. The output voltage Vcom_out of the common voltage buffer 81 may be input to a first input terminal of the second amplifier Amp2, and a drain of the third transistor Tr3 may be connected to the second input terminal of the second amplifier Amp2. For example, the first input terminal of the first amplifier Amp1 may be a non-inverting terminal, and the second input terminal thereof may be an inverting terminal. The second amplifier Amp2 may operate so that the voltages of both input terminals are the same. Thus, the same voltage as the output voltage Vcom_out may be applied to the drain of the third transistor Tr3 connected to the second input terminal of the second amplifier Amp2. Accordingly, the current flowing through the first transistor Tr1 and the current having the same intensity may flow through the third transistor Tr3, and mismatching of the current may be solved.

The current generator 83 may copy the first current $I_{sourcing}$ applied to the first transistor Tr1 and apply the first current $I_{sourcing}$ to the third transistor Tr3. The first current $I_{sourcing}$ may be output to the current detector 85, and may be converted into a first output voltage V_source through the seventh transistor Tr7 and the first resistor R1. The current generator 83 may copy the second current $I_{sinking}$ applied to the second transistor Tr2 and apply the second current $I_{sinking}$ to the fourth transistor Tr4. The current applied to the fourth transistor Tr4 may be mirrored through an eighth transistor Tr8 and a current mirror 87 to be applied to the sixth transistor Tr6. The mirrored current may be output to the current detector 85. The mirrored current may pass through the second resistor R2 and be converted into a second output voltage V_sink.

When the first output voltage V_source higher than the preset voltage Vref is input due to a short circuit, a second comparator COMP2 may output a high level signal. In addition, when a second output voltage V_sink higher than the preset voltage Vref is input due to the short circuit, a first comparator COMP may output a high level signal.

The display driving integrated circuit 80 may output currents respectively corresponding to the first current $I_{sourcing}$ and the second current $I_{sinking}$ from the current generator 83, convert the output currents respectively into the first output voltage V_source and the second output voltage V_sink, and compare the first output voltage V_source and the second output voltage V_sink with a preset voltage, thereby providing a short circuit detection circuit of high accuracy.

Figure 8:
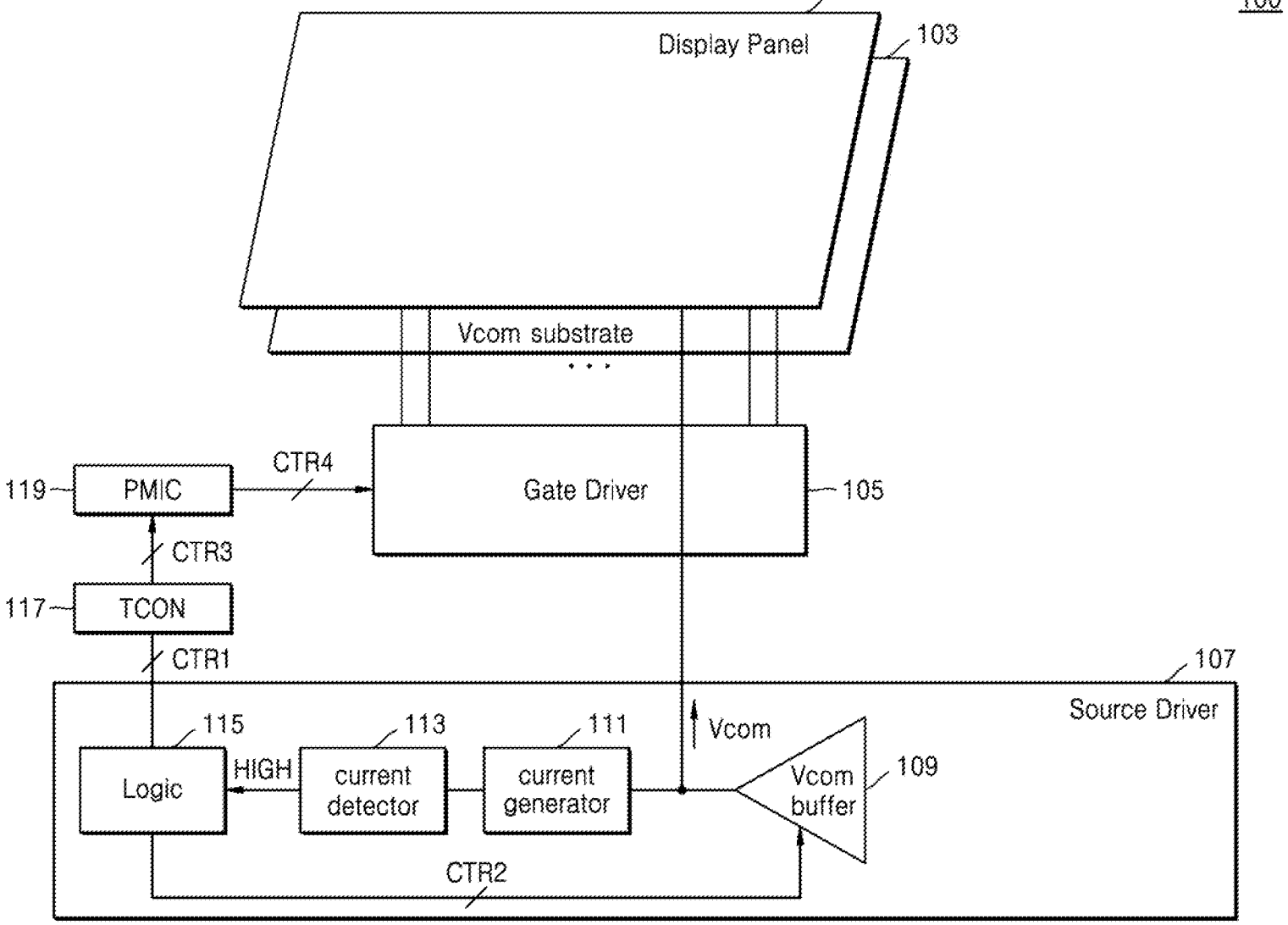
FIG. 8 illustrates a display device according to an example embodiment.
Figure 9:
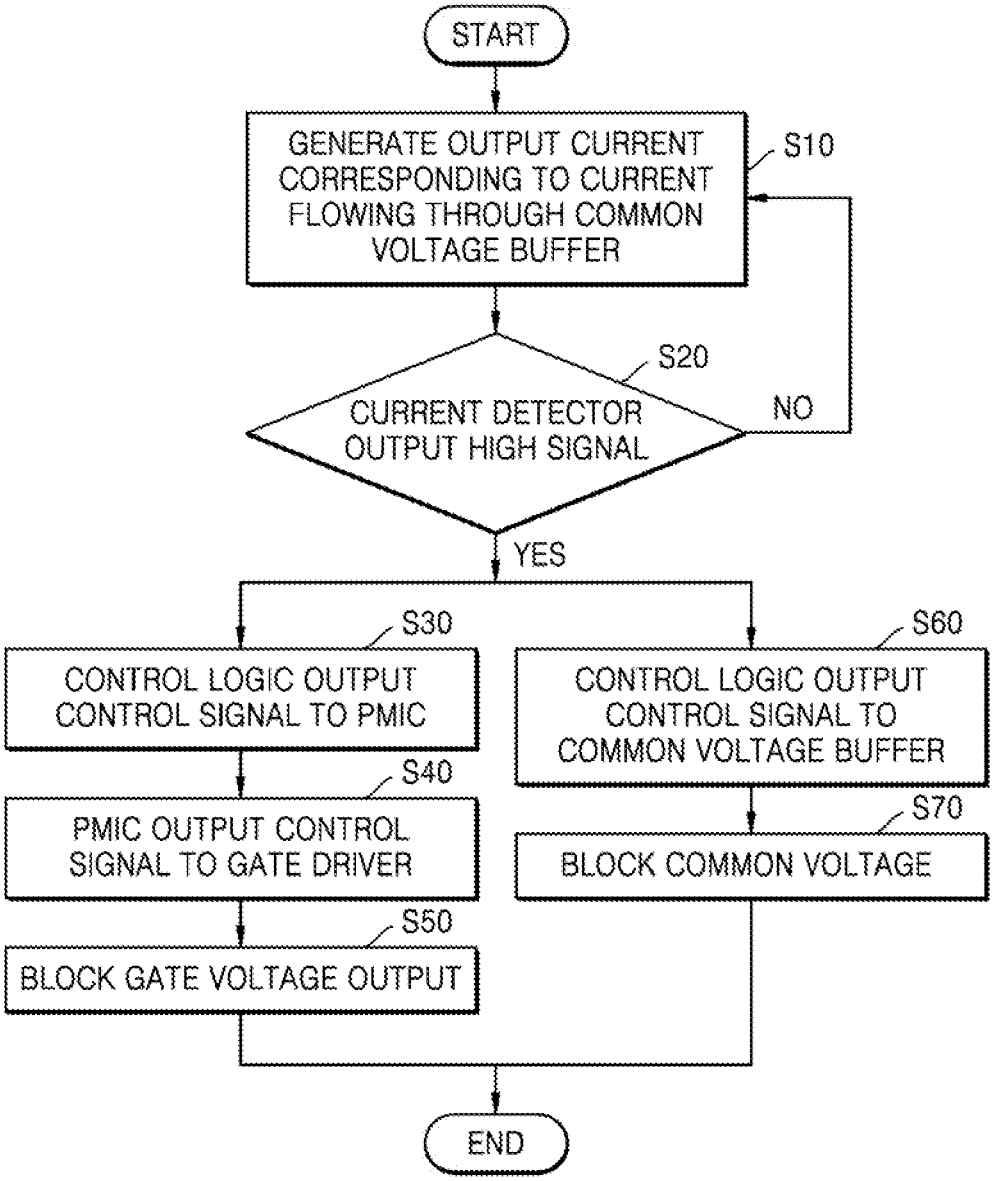
FIG. 9 is a flowchart illustrating controlling an output voltage when a short circuit is detected in the display device of FIG. 8 according to an example embodiment.

FIG. 8 illustrates a display device 100 according to an example embodiment. FIG. 9 is a flowchart illustrating controlling an output voltage when a short circuit is detected in the display device 100 of FIG. 8 according to an example embodiment.

Referring to FIG. 8, the display device 100 may include a display panel 101, a common voltage substrate 103, a gate driver 105, a source driver 107, a TCON 117, and a PMIC 119. Similarly to that described above in connection with FIG. 1, the source driver 107 may include a common voltage buffer 109, a current generator 111, a current detector 113, and a control logic 115. Hereinafter, the description of FIG. 8 redundant with the description of FIG. 1 will be omitted.

The TCON 117 may receive a horizontal synchronization signal, a vertical synchronization signal, a clock signal, and a data enable signal for driving image data from a processor. The TCON 117 may control driving timing of the gate driver 105 and the source driver 107 based on the received signals. The TCON 117 may convert a format of image data to meet the specification of an interface with the source driver 107 and provide the image data to the source driver 107.

The PMIC 119 may receive power to supply and manage power used by the display device 100. The PMIC 119 may convert the supplied power into an output voltage and rectify the output voltage into an output current. The PMIC 119 may include a low drop out regulator (LDO), a real time clock, a DC/DC buck converter, a switching regulator, etc., and may be implemented as a system on chip (SoC). In an example embodiment, the PMIC 119 may receive power and supply power used by the gate driver 105, the source driver 107, and the TCON 117.

Referring to FIG. 9, in operation S10, the current generator 111 may generate an output current corresponding to the current flowing through the common voltage buffer 109.

For example, the current generator 111 may generate an output current corresponding to the current flowing through the common voltage buffer 109 through a current mirror structure. The current detector 113 may convert the output current into an output voltage and output a high or low signal based on a result of comparing the output voltage to a preset voltage. In operation S20, when a common voltage output line and a gate line are short-circuited, an output voltage greater than a common voltage is input, and the current detector 113 may output a high level signal. When the common voltage output line and the gate line are not short-circuited, the current detector 113 may output a low level signal.

In operation S30, the control logic 115 may receive a signal output from the current detector 113. When receiving the high level signal from the current detector 113, the control logic 115 may output a control signal CTR3 to the PMIC 119. In operation S40, the PMIC 119 may output a control signal CTR4 to the gate driver 105 in response to the control signal CTR3. In operation S50, the gate driver 105 may block a gate voltage output according to a logic state of the control signal CTR4.

In another example embodiment, when receiving the high level signal from the current detector 113, the control logic 115 may output a control signal CTR1 to the TCON 117. The TCON 117 may output the control signal CTR3 to the PMIC 119 in response to the control signal CTR1.

The PMIC 119 may output the control signal CTR4 to the gate driver 105 in response to the control signal CTR3. The gate driver 105 may block a gate voltage output according to the logic state of the control signal CTR4. Thus, when a short circuit between the common voltage output line and the gate line is detected by the current detector 113, a display driving integrated circuit may protect a display panel by generating a plurality of control signals and blocking the gate voltage output.

In operation S60, when receiving the high level signal from the current detector 113, the control logic 115 may output a control signal CTR2 to the common voltage buffer 109. In operation S70, the common voltage buffer 109 may block a common voltage output according to a logic state of the control signal CTR2. Thus, when the short circuit between the common voltage output line and the gate line is detected by the current detector 113, the display driving integrated circuit may protect the display panel by generating the control signal and blocking the common voltage output.

By way of summation and review, a pixel electrode may be used for, e.g., for driving a liquid crystal. An angle of the liquid crystal may be adjusted by a difference between a voltage applied to the pixel electrode and a common voltage Vcom applied to a common electrode, and a transmittance of light may be adjusted according to the angle of the liquid crystal.

As described above, embodiments relate to a display driving integrated circuit for detecting a short circuit, e.g., between a gate line and a common voltage output line.

Embodiments may provide a display driving integrated circuit and a display device for detecting a short circuit between a common voltage output line and a gate line.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A display driving integrated circuit, comprising:

a common voltage buffer configured to provide a common voltage to a display panel and, when a line outputting the common voltage and a gate line are short-circuited, apply a first current to the gate line or receive a second current from the gate line;

a current generator configured to sum currents respectively corresponding to the first current and the second current, and output an output current obtained by the summing; and a current detector configured to convert the output current into an output voltage, and output a high or low signal based on a result of comparing the output voltage with a preset voltage.

2. The display driving integrated circuit as claimed in claim 1, wherein:

the first current is applied to the gate line through a first transistor, the second current is applied from the gate line to a second transistor, and the first transistor and the second transistor are sequentially connected in series between a power supply voltage and ground.

3. The display driving integrated circuit as claimed in claim 2, wherein:

the first transistor includes a PMOS transistor, the second transistor includes an NMOS transistor, and the current generator includes a third transistor including a PMOS transistor having a gate connected to a gate of the first transistor and having a source to which a voltage of the same magnitude as a power voltage is applied.

4. The display driving integrated circuit as claimed in claim 3, wherein the current generator includes a fourth transistor including an NMOS transistor having a gate connected to a gate of the second transistor and having a source connected to ground.

5. The display driving integrated circuit as claimed in claim 4, wherein the current generator includes a current mirror connected to the fourth transistor and configured to generate a mirror current that is the same as a current flowing through the fourth transistor.

6. The display driving integrated circuit as claimed in claim 5, wherein the current mirror and the third transistor are connected to each other through a first node.

7. The display driving integrated circuit as claimed in claim 6, wherein the current detector includes an amplifier having a first input terminal connected to the first transistor and the second transistor, and having a second input terminal connected to the third transistor and the current mirror.

8. The display driving integrated circuit as claimed in claim 1, wherein the current detector includes:

a resistor through which the output current passes and configured to convert the output current into the output voltage; and a comparator configured to output the high or low signal according to the result of comparing the output voltage to the preset voltage.

9. A display driving integrated circuit, comprising:

a common voltage buffer configured to provide a common voltage to a display panel and, when a line outputting the common voltage and a gate line are short-circuited, apply a first current to the gate line or receive a second current from the gate line;

a current generator configured to generate output currents respectively corresponding to the first current and the second current; and a current detector configured to convert the output currents respectively into a first output voltage and a second output voltage, and output a high or low signal based on a result of comparing the first output voltage with a preset voltage and a result of comparing the second output voltage with the preset voltage.

10. The display driving integrated circuit as claimed in claim 9, wherein:

the first current is applied to the gate line through a first transistor, the second current is applied from the gate line to a second transistor, and the first transistor and the second transistor are sequentially connected in series between a power supply voltage and ground.

11. The display driving integrated circuit as claimed in claim 10, wherein:

the first transistor includes a PMOS transistor, the second transistor includes an NMOS transistor, and the current generator includes a fourth transistor including an NMOS transistor having a gate connected to a gate of the second transistor and a source connected to ground.

12. The display driving integrated circuit as claimed in claim 11, wherein the current generator includes a first amplifier having a first input terminal connected to the first transistor and the second transistor, and having a second input terminal connected to the fourth transistor.

13. The display driving integrated circuit as claimed in claim 10, wherein the current detector includes:

a first resistor configured to convert the output current corresponding to the first current into the first output voltage, and a second resistor configured to convert the output current corresponding to the second current into the second output voltage.

14. The display driving integrated circuit as claimed in claim 13, wherein the current detector further includes:

a first comparator configured to output the high or low signal according to a result of comparing the first output voltage to the preset voltage; and a second comparator configured to output the high or low signal according to a result of comparing the second output voltage to the preset voltage.

15. A display device, comprising:

a common voltage buffer configured to provide a common voltage to a display panel and, when a line outputting the common voltage and a gate line are short-circuited, apply a first current to the gate line or receive a second current from the gate line;

a current generator configured to generate an output current corresponding to at least one of the first current and the second current;

a current detector configured to convert the output current into an output voltage, and output a high or low signal based on a result of comparing the output voltage with a preset voltage; and a control logic configured to receive an output signal from the current detector, and generate a control signal according to the output signal.

16. The display device as claimed in claim 15, further comprising a power management integrated circuit (PMIC), wherein the control signal is a signal controlling at least one of the PMIC and the common voltage buffer.

17. The display device as claimed in claim 16, further comprising a timing controller (TCON), wherein the TCON is configured to output a signal controlling the PMIC according to a logic state of a signal generated by the control logic.

18. The display device as claimed in claim 16, further comprising a gate driver, wherein the PMIC is configured to output a signal blocking a gate voltage output to the gate driver, according to a logic state of a signal generated by the control logic.

19. The display device as claimed in claim 16, wherein the common voltage buffer is configured to block output of the common voltage, according to a logic state of a signal generated by the control logic.

20. The display device as claimed in claim 15, further comprising a source driver, wherein the source driver includes the common voltage buffer, the current generator, and the current detector.

* * * * *